US007866262B2

(12) United States Patent
Seyfried

(10) Patent No.: US 7,866,262 B2
(45) Date of Patent: Jan. 11, 2011

(54) IMAGE RESPONSIVE PIVOTING PRESSURE ROLL

(75) Inventor: Richard Seyfried, Williamson, NY (US)

(73) Assignee: Xerox Corporation, Stamford, CT (US)

( * ) Notice: Subject to any disclaimer, the term of this patent is extended or adjusted under 35 U.S.C. 154(b) by 262 days.

(21) Appl. No.: 11/490,641

(22) Filed: Jul. 21, 2006

(65) Prior Publication Data

US 2008/0017062 A1 Jan. 24, 2008

(51) Int. Cl.
*G03G 15/20* (2006.01)
*B41L 35/14* (2006.01)

(52) U.S. Cl. ..... 101/488; 399/329

(58) Field of Classification Search ..... 101/488, 101/DIG. 42, 424.1, 487; 399/328, 330, 399/400, 388, 329, 335, 336, 338; 347/11, 347/19, 102, 225; 34/299, 399; *B41K 35/14*
See application file for complete search history.

(56) References Cited

U.S. PATENT DOCUMENTS 2,083,142 A * 6/1937 Buck ..... 26/92
6,058,844 A * 5/2000 Niemiec ..... 101/488
6,520,634 B2 * 2/2003 Yoshinaga et al. ..... 347/102
6,741,832 B2 * 5/2004 Tomatsu ..... 399/400
6,985,250 B2 1/2006 Folkins
7,021,732 B2 4/2006 Folkins
2003/0128385 A1 7/2003 Folkins
2003/0185598 A1 10/2003 Folkins et al.
2004/0114015 A1 * 6/2004 Tarnawskyj et al. ..... 347/101
2005/0036023 A1 * 2/2005 Costanza et al. ..... 347/104
2005/0088670 A1 4/2005 Folkins
2005/0089349 A1 4/2005 Folkins
2005/0099439 A1 5/2005 Folkins
2005/0111896 A1 5/2005 Aviles et al.
2005/0158106 A1 * 7/2005 Winter et al. ..... 400/619
2006/0012667 A1 * 1/2006 Franklin ..... 347/225
2006/0066657 A1 3/2006 Folkins et al.
2006/0098251 A1 5/2006 Eklund et al.

* cited by examiner

*Primary Examiner*—Judy Nguyen
*Assistant Examiner*—Jennifer Simmons
(74) *Attorney, Agent, or Firm*—Carter, DeLuca, Farrell & Schmidt, LLP

(57) ABSTRACT

According to an aspect of the present disclosure; a method of processing a substrate media having an image injected thereon is provided and includes the step of passing the substrate media through a nip defined between a heated fuser drum and a pressure roll. A fixer subsystem, for use in a system for printing on a substrate media, where the subsystem includes a rotatable, heatable fuser drum defining an axis of rotation; and a rotatable pressure roll operatively associated with the fuser drum and defining an axis of rotation substantially parallel to the axis of rotation of the fuser drum. The pressure roll is rotatable about the axis of rotation of the fuser drum to vary a length of contact of substrate media and image with fuser drum.

9 Claims, 8 Drawing Sheets

IMAGE RESPONSIVE PIVOTING PRESSURE ROLL

BACKGROUND

1. Technical Field

The present disclosure relates generally to image producing machines and, more particularly, to image producing machines including a pivoting pressure role under a high load for achieving improved image quality in a DTP, Solid-Ink-Jet (SIJ) web process.

2. Background of Related Art

Direct-to-Paper (DTP)/Media printing involves the injection of ink or the like directly onto the print media (e.g., web, paper, etc.) to form an image or the like. Before the image can be fused/squished/spread to the print media, the print media with the image provided thereon passes by non-contact heat panels or mid-heat panels to bring the injected image to the correct melting point for image fixing.

In general, SIJ type printers employ phase change inks that are in a solid phase at ambient temperature, but exist in the molten or melted liquid phase (and can be ejected as drops or jets) at the elevated operating temperature of the printer. At such an elevated operating temperature, droplets or jets of the molten or liquid ink are ejected from a printhead device of the printer onto the printing media. Such ejection can be directly onto a final image receiving substrate, or indirectly onto an imaging member before transfer from it to the final image receiving media. In any case, when the ink droplets contact the surface of the printing media, they quickly solidify to create an image in the form of a predetermined pattern of solidified ink drops.

It has been discovered that relatively effective image transfer in an ordinary speed (12-32 copies per minute) solid ink printer can be achieved from having the substrate pre-heated or heated prior to image transfer. Conventionally, a single stage pre-heater has been used to transfer heat to the substrate prior to the substrate being registered for image transfer. Unfortunately, it has been found that in relatively high speed (40 and more copies per minute) solid ink printers, for example, a single stage heater tends to transfer insufficient heat or too much heat to the substrate. This is because such printers call for substrates to be transported at the high substrate transport speeds, such as approximately 1524 mm/sec or 60 in/sec.

Due to these increased process speeds, non-contact mid-heat panels may be heated to about 700° C., thus consuming a significant amount of energy. If the print media were to touch the mid-heat panels scorching of the media or even a fire could occur.

Accordingly, a need exists for a fixer subsystem including a simpler preheating system to replace the mid-heat panels, thereby saving machine and energy cost.

SUMMARY

The present disclosure relates generally to image producing machines, systems, subsystems and the like.

According to an aspect of the present disclosure, a fixer subsystem for use in a system for printing on a substrate media is provided. The subsystem includes a rotatable, heatable fuser drum defining an axis of rotation; and a rotatable pressure roll operatively associated with the fuser drum and defining an axis of rotation substantially parallel to the axis of rotation of the fuser drum. The pressure roll is rotatable about the axis of rotation of the fuser drum to vary a length of contact of substrate media with fuser drum. The fuser drum and the pressure roll define a nip therebetween for passage of the substrate media therethrough.

It is contemplated that a dwell time of the substrate media in contact with the fuser drum may be varied by varying an angular position of the pressure roll relative to the fuser drum.

The pressure roll may be rotatable about the axis of rotation of the fuser drum by an angle of less than about 35°. The pressure roll may be rotated about the axis of rotation of the fuser drum by an angle of from about 35° to 180°. When the pressure roll is at approximately a 0° angle of rotation relative to the fuser drum, the substrate material and image may be in contact with the fuser drum for approximately 2°.

The fuser drum may have a temperature of about 45° C. to about 70° C.

The axis of rotation of the pressure roll may be adjustable relative to the axis of rotation of the fuser drum. The fixer subsystem may include a fuser mount rotatably supporting the fuser drum; a load frame rotatably supporting the pressure roll, the load frame being pivotable about the axis of rotation of the fuser drum; and a tilting mechanism operatively interconnecting the fuser mount and the load frame, wherein the tilting mechanism is operable to vary an angular position of the pressure roll relative to the fuser drum.

The tilting mechanism may include a drive motor secured to one of the fuser mount and the load frame, a pivoting nut secured to the other of the fuser mount and the load frame, and a lead screw extending from the drive motor and through the pivoting nut. In operation the drive motor rotates the lead screw to move the pivoting nut along a length of the lead screw and vary an angle between the fuser mount and the load frame.

According to another aspect of the present disclosure, a method of processing a substrate media having an image injected thereon is provided. The method includes the step of passing the substrate media through a nip defined between a heated fuser drum and a pivoting pressure roll.

The method may further include the step of rotating the pressure roll around an axis of rotation of the fuser drum to vary a dwell time of the substrate media and image in contact with the fuser drum.

The method may further include the step of rotating the pressure roll about the axis of rotation of the fuser drum from about 0° to about 35°. The method may include the step of rotating the pressure roll about the axis of rotation of the fuser drum from about 35° to about 180°.

The substrate media may be in contact with the fuser drum for at least 2° prior to passage through the nip.

The method may further include the step of varying a dwell time of the substrate media and image in contact with the fuser drum depending on a density of an image present on the substrate media. The method may further include the step of increasing the dwell time of the substrate media and image in contact with the fuser drum for images having a relatively higher density.

BRIEF DESCRIPTION OF THE DRAWINGS

Various embodiments of the present disclosure will be described herein below with reference to the figures wherein.

DETAILED DESCRIPTION OF EMBODIMENTS

While the present invention will be described in connection with preferred embodiments thereof, it will be understood that it is not intended to limit the invention to said embodiments. On the contrary, it is intended to cover all alternatives, modifications, and equivalents as may be included within the spirit and scope of the invention as defined by the appended claims.

Figure 1:
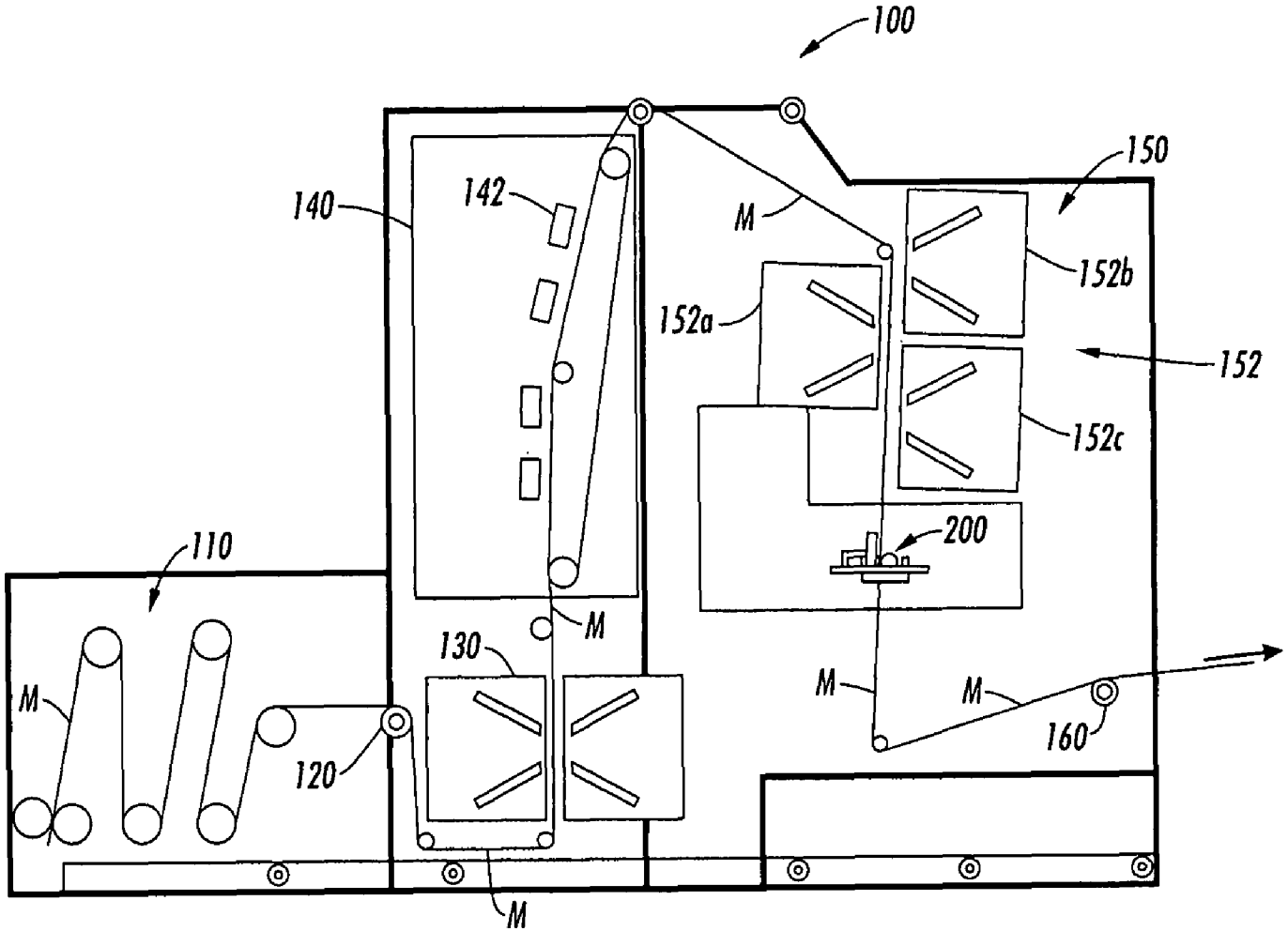
FIG. 1 is a schematic plan view of a printing system according to an embodiment of the present disclosure.

Referring now to FIG. 1, a printing system 100 in accordance with an embodiment of the present disclosure is illustrated. As seen in FIG. 1, a substrate media "M" (i.e., paper web, films, plastics, metals or whatever other suitable type of substrate media) is pulled out of an unwinder 110 thru an abatement subsystem 120, a pre-heating station 130, and an imaging station 140 (e.g., monochromatic, black & white or color) where an image is injected onto substrate media "M" from print heads 142.

Substrate media "M", including the image injected thereon, then travels down thru a mid-heat station 150. Mid-heat station 150 includes a plurality of non-contact heater boxes 152. In one embodiment, mid-heat station 150 includes three radiant non-contact heater boxes 152*a*-152*c*, a first heater box 152*a* positioned behind substrate media "M" and the image injected thereon, and a second and third heater box 152*b*, 152*c* positioned in front of substrate media "M" and the image injected thereon. Mid-heat station 150 may be capable of raising a surface temperature of substrate media "M" from about 60° C. to 250° C. Mid heat station 150 functions to heat substrate media "M" and the image injected thereon for fixer subsystem 200.

Upon leaving mid-heat station 150, substrate media "M" and the image injected thereon travels to a fixer subsystem 200 for a print process comprised of fixing the image to substrate media "M". It is contemplated for fixer subsystem 200 to be located downstream of mid-heat station 150 by a distance sufficient for substrate media "M" and the image injected thereon to cool down a predetermined amount. The amount of cooling is dependent upon the distance of travel, the speed of travel, the ambient temperature and the like.

Following passage through fixer subsystem 200, the image is fixed to substrate media "M". Substrate media "M" is thereafter pulled, by a separate pinch roller 160, to one of a plurality of possible finishing stations for custom cutting, stitching, binding, etc.

Figure 2:
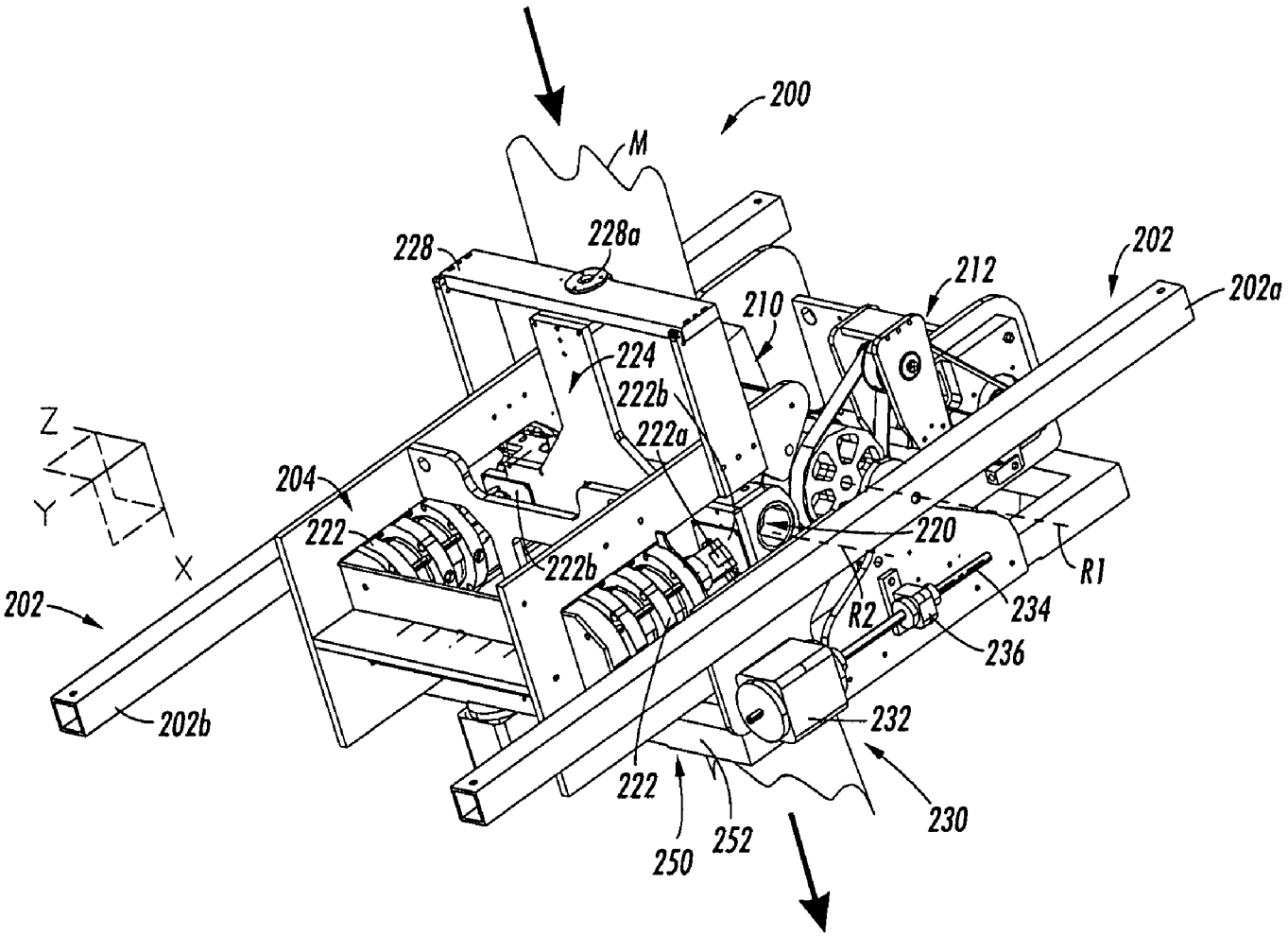
FIG. 2 is a perspective view of a fixer subsystem, of the printing system of FIG. 1, according to an embodiment of the present disclosure, shown in a first condition.
Figure 3:
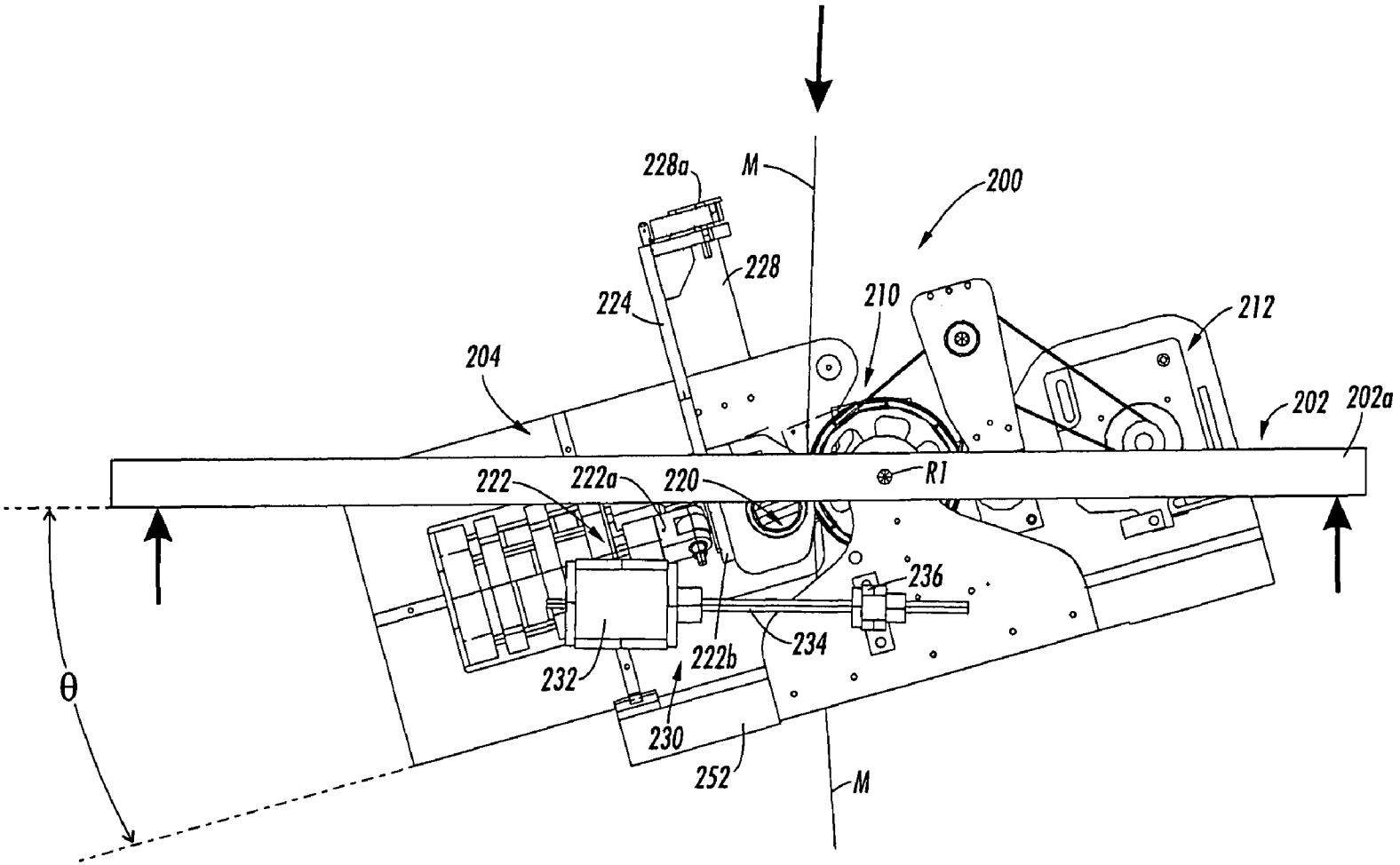
FIG. 3 is a side-elevational view of the fixer subsystem of FIG. 2, shown in a second condition.
Figure 4:
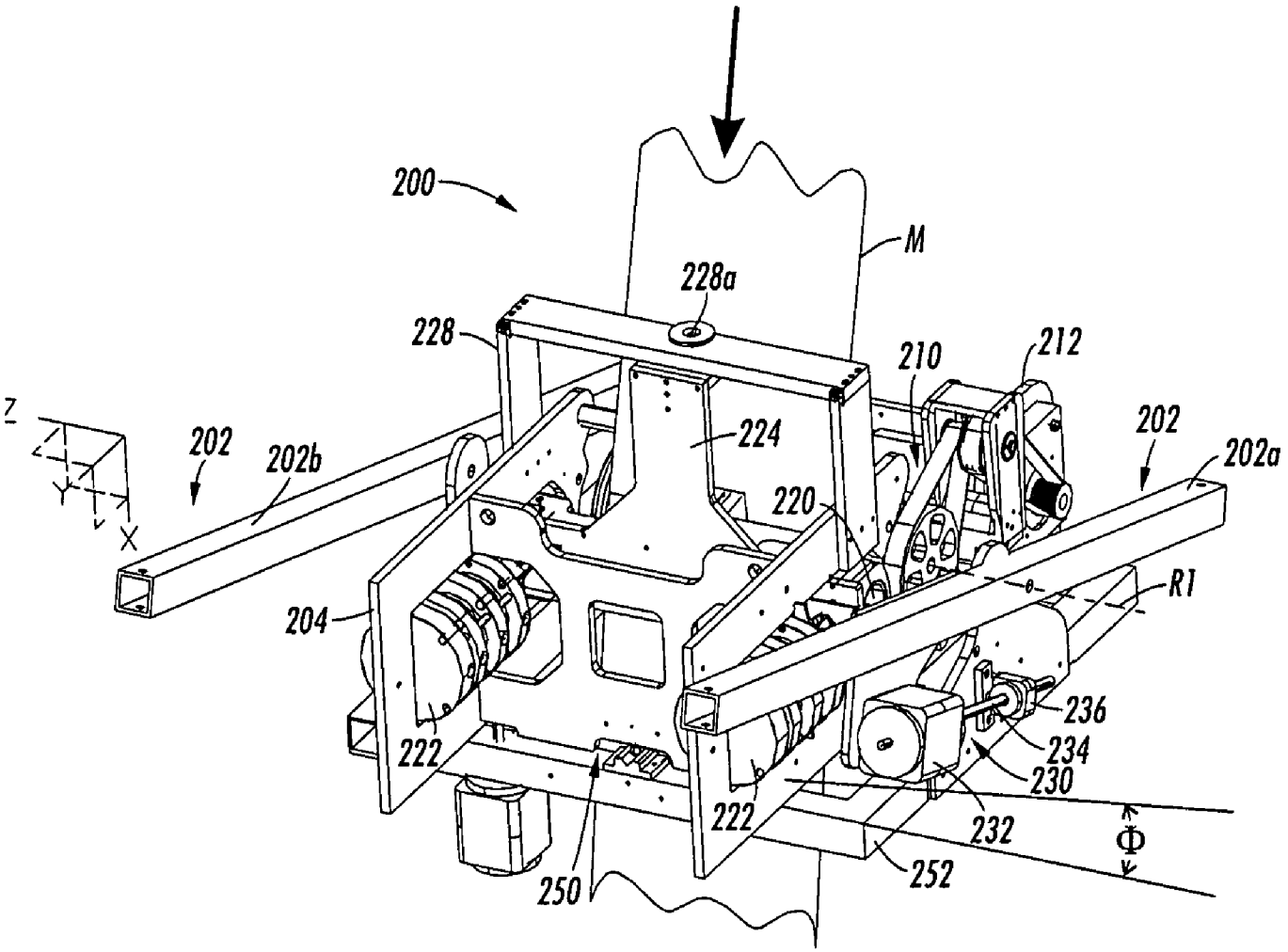
FIG. 4 is a perspective view of the fixer subsystem of FIGS. 2 and 3, shown in the second condition.

Turning now to FIGS. 2-8, a detailed discussion of fixer subsystem 200 is provided. With reference to FIGS. 2-4, fixer subsystem 200 includes a fuser mount 202 including a pair of spaced apart rails 202*a*, 202*b*; a fuser drum 210 operatively disposed between rails 202*a*, 202*b*; and a load frame 204 operatively supported on fuser mount 202. Fuser drum 210 defines an axis of rotation "R1" extending through and preferably, substantially orthogonal to rails 202*a*, 202*b*. Load frame 204 is pivotably supported on rails 202*a*, 202*b* at a pivot point 204*a* that is aligned with the axis of rotation "R1" of fuser drum 210.

Fuser drum 210 is selectively heatable to a suitable desired temperature, such as, for example, between about 45° C. to about 90° C. As will be discussed in greater detail below, fuser drum 210 is heated in order to either perform the function of mid-heat station 150 or to assist mid-heat station 150 in heating substrate media "M". By providing a heated fuser drum 210, heater boxes 152 of mid-heat station 150 may be run at lower temperatures in order to reduce the incidence of melting, fire and/or distortion of substrate media "M". This reduction in temperature of heater boxes 152 results in reduced energy consumption and the like.

Fuser drum 210 may be driven by any suitable mechanism or the like, including and not limited to drive motor 212. Drive motor 212 may be capable of driving fuser drum 210 such that fixer subsystem 200 has a process speed of between approximately 10 ips (inches per second) to approximately 60 ips, and preferably, about 10, 40 and 60 ips. Fuser drum 210 may have an outer diameter of about 6.4 inches (162.5 mm).

With reference to FIGS. 2-8, fixer subsystem 200 further includes a pressure roll 220 rotatably supported on a backbone or frame 224 and placed in operative association with load frame 204. Pressure roll 220 is in operative association with fuser roll 210 to define a nip therebetween through with substrate media "M" passes. Pressure roll 220 defines an axis of rotation "R2" substantially parallel to the axis of rotation "R1" of fuser roll 210.

Pressure roll 220 may have an outer diameter of about 2.76 inches (70mm). Pressure roll 220 is operatively associated with fuser roll 210 so as to exert and suitable nip pressure on substrate media "M" traveling therebetween, such as, for example, between about 500 psi, which is typically the minimum pressure to drive the system and achieve minimum fix, up to about 1500 psi.

Pressure roll 220 is pressed against or in the direction of fuser roll 210 by at least one piston 222 supported on load frame 204. Desirably, a pair of pistons 222 are supported on load frame 204 and are located proximal opposed ends of pressure roll 220 in order to exert a force on said opposed ends of pressure roll 220. For example, each piston 222 may extend a respective needle bearing 222*a* to exert a point force load against a respective bearing plate 222*b*, supported on backbone 224, in order to prevent and/or reduce the incidence of failure such as galling between needle bearings 222*a* and the respective bearing plate 222*b*. A spring 226 (see FIGS. 5-8) is provided for moving pressure roll 220 away from fuser drum 210 when the pressure applied thereto, by piston(s) 222, is/are removed and/or reduced. Since pressure roll 220 and bearing plate 222*b* are not coupled to needle bearing(s) 222*a*, upon removal and/or reduction of pressure from pressure roll 220 when in contact with fuser drum 210, pressure roll 220 is free to seek and move to a neutral stand by position.

Fixer subsystem 200 further includes a tilting mechanism 230 operatively associated with fuser mount 202 and load frame 204 for pivoting load frame 204 relative to fuser mount 202 about axis of rotation "R1" of fuser drum 210. Tilting mechanism 230 includes a drive motor 232 fixedly supported on fuser mount 202, a lead screw 234 extending from and rotatably driven by drive motor 232, and a lead screw pivoting nut 236 pivotally supported on load frame 204 and threadably associated with lead screw 234.

In operation, as drive motor 232 rotates lead screw 234 in a first direction, pivoting nut 236 is moved in a first direction along lead screw 234 and thus causes load frame 204 to pivot in a first direction about the axis of rotation "R1" of fuser drum 210, relative to fuser mount 202. Likewise, as drive motor 232 rotates lead screw 234 in a second direction (opposite the first direction), pivoting nut 236 is moved in a second direction along lead screw 234 and thus causes load frame 204 to pivot in a second direction about the axis of rotation "R1" of fuser drum 210, relative to fuser mount 202.

As load frame 204 is pivoted relative to fuser mount 202, since pressure roll 210 is supported on load frame 204, pressure roll 220 is caused to be rotated about the axis of rotation "R1" of fuser drum 210 as well. Accordingly, as pressure roll 220 is rotated about the axis of rotation "R1" of fuser drum 210, a length of substrate media "M" in contact with fuser drum 210 is varied. By varying the length of substrate media "M" in contact with fuser drum 210, a temperature of substrate media "M" may be controlled and/or varied as needed and/or desired. It is readily understood that the greater the length of substrate media "M" in contact with fuser drum 210 the relatively higher of a temperature substrate media "M" and image will attain, and the smaller the length of substrate media "M" in contact with fuser drum 210 the relatively lower of a temperature substrate media "M" and image will attain. This control of temperature of substrate media "M" and image is important when a printer is in a "duplex mode" in order to prevent first side image offset, where the first fused image is heated sufficiently to become a fluid film and thereby the fluid film splits and moves to pressure roll 220.

In accordance with the present disclosure, pressure roll 220 may be rotated about fuser drum 210 by a degree "Θ" of from approximately 0° (see FIGS. 5-6) to approximately 35° (see FIGS. 7-8), thereby wrapping a length of substrate media "M" around fuser drum 210. The greater the length of substrate media "M" wrapped about fuser drum 210 the greater the relative dwell time of substrate media "M" and image on fuser drum 210. Since fuser drum 210 is heated, this physical contact of substrate media "M" and image with fuser drum 210 results in heat transfer from fuser drum 210 to substrate media "M" and image thereby increasing a temperature of substrate media "M" and image. It is contemplated that when pressure roll 220 is at a 0° position relative to fuser drum 210, that substrate media "M" and image is in contact with fuser drum 210 for approximately 2°.

The following table will illustrate the degree of wrap of substrate media "M" as a result of the angular position of pressure roll 220 relative to fuser drum 210 and the length of substrate media "M" in contact with fuser drum 210 as can be seen from the table, increasing the fusing drum diameter approximately 50% increases the contact length a similar amount.

| Wrap angle (Degrees) | Length of Contact (mm) with a 162 mm Diameter Fuser Drum | Length of Contact (mm) with a 243 mm Diameter Fuser Drum |
|---|---|---|
| 0 | 2.8 | 4.2 |
| 5 | 9.9 | 14.9 |
| 10 | 17.0 | 25.5 |
| 15 | 24.0 | 36.0 |
| 20 | 31.1 | 47.0 |
| 25 | 38.2 | 57.3 |
| 30 | 45.2 | 67.8 |
| 35 | 52.3 | 78.5 |

As seen in FIGS. 2 and 4, backbone 224 depends from and is operatively connected to an upright 228 thereby enabling pressure roll 220 to be moved toward and away from fuser drum 210 in an arcuate or pendulum-like manner. A pivot ball 228*a* may be interposed between backbone 224 and upright 228 in order to facilitate movement of backbone 224 relative to upright 228. In this manner, pressure roll 220 is allowed to gimbal in an X and Z direction while remain grounded in a Y direction. This will allow pressure roll 220 to find its optimal pressure position against fuser drum 210 without causing substrate media "M" to walk off either pressure roll 220 or fuser drum 210.

Fixer subsystem 200 further includes an adjustment mechanism 250 for rotating pressure roll 220 and fuser drum 210 in an X direction without disturbing the printing process. Adjustment mechanism 250 includes a cradle 252 for making pivotable adjustments in the X direction. Pivotable adjustments in the X direction are desirable in order balance substrate media "M" between a lead in roller and an exit roller in order to prevent substrate media "M" from walking off pinch rollers or the like. Pivotable adjustment in the X direction may be by approximately +/−2° about a center line of fuser drum 210 as indicated by reference character "Φ" in FIG. 4.

Figure 5:
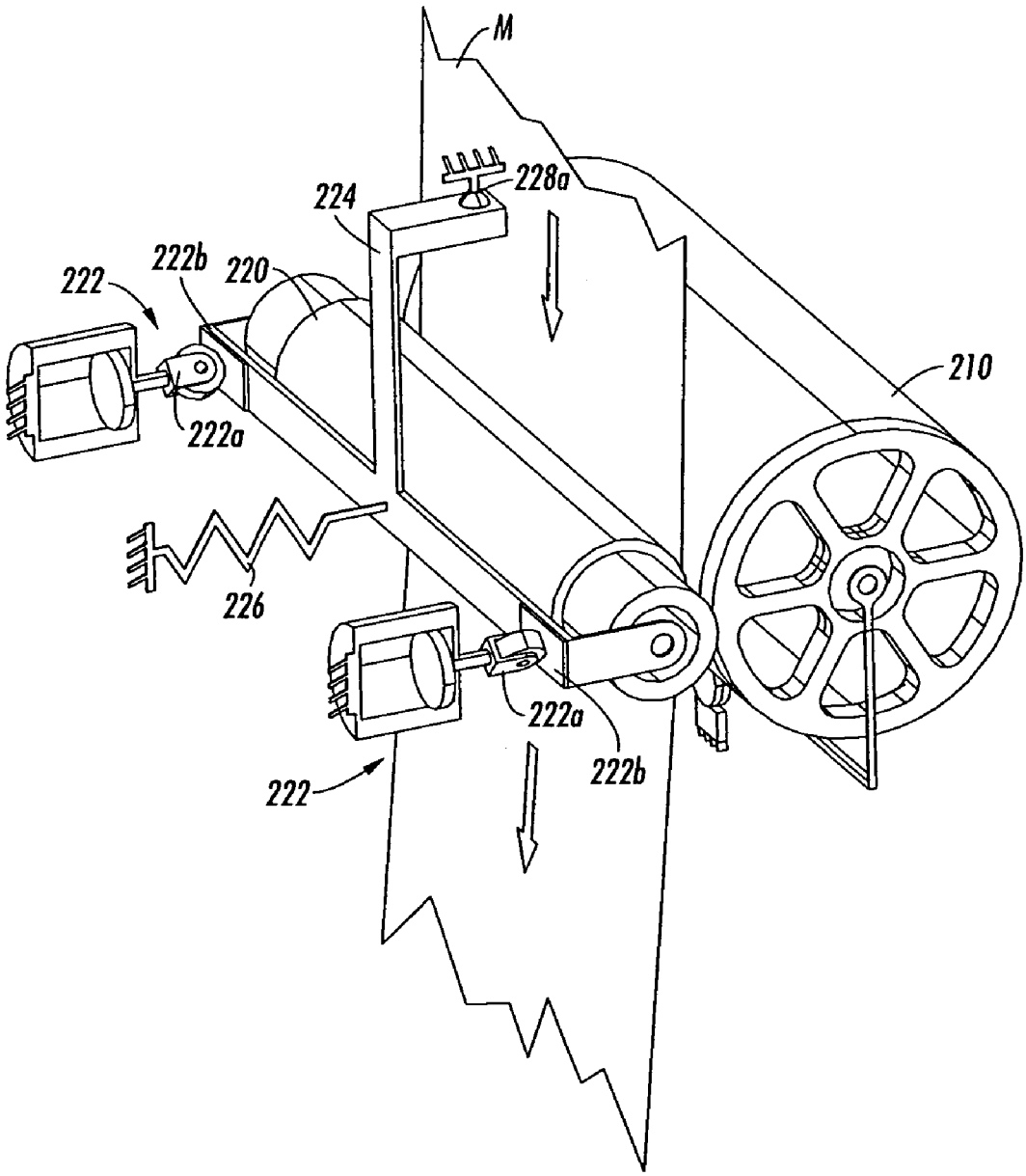
FIG. 5 is a schematic, perspective view of the fixer subsystem of FIGS. 2-4, shown in the first condition.
Figure 6:
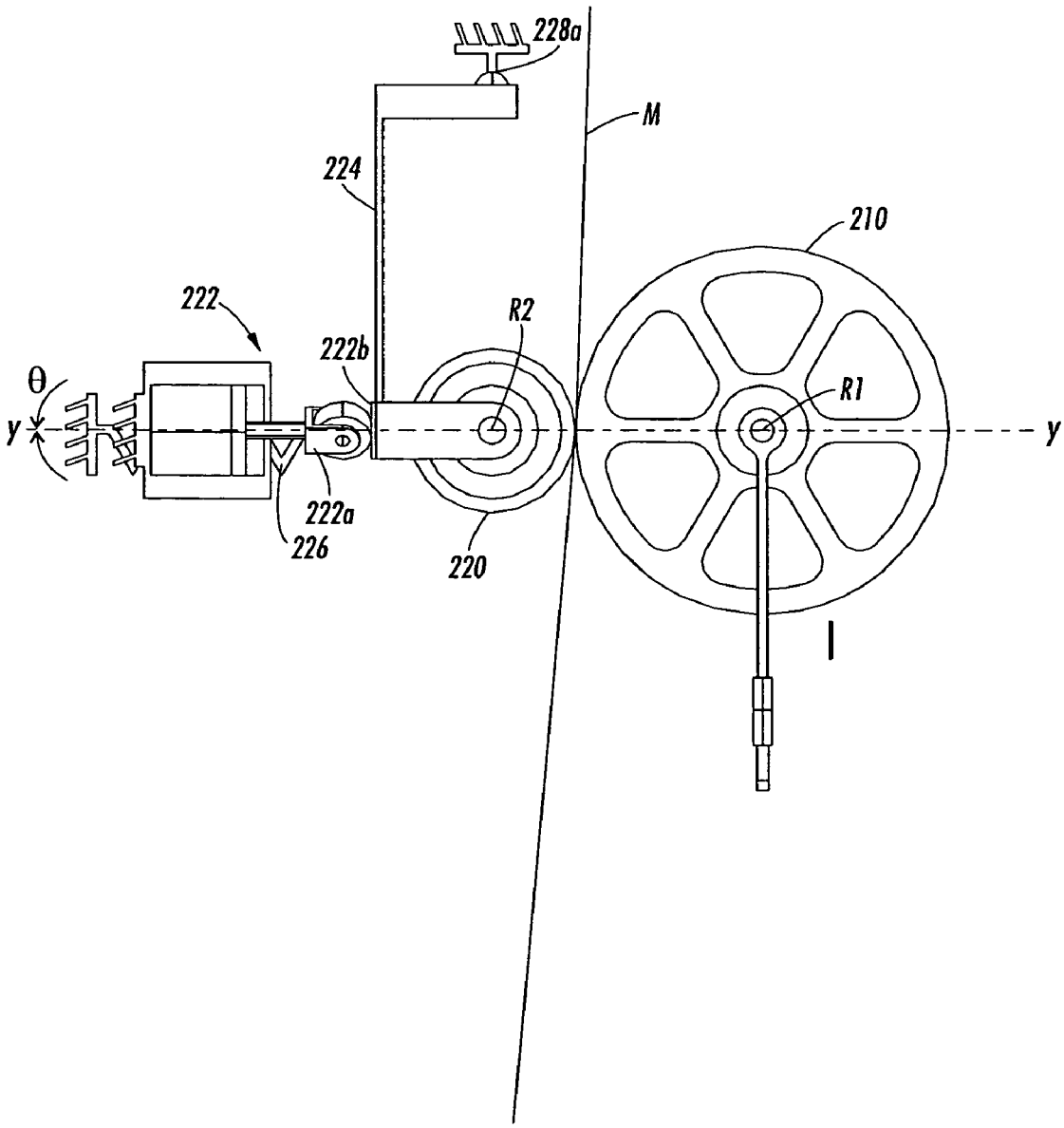
FIG. 6 is a schematic, side-elevational view of the fixer subsystem of FIGS. 2-4, shown in the first condition.
Figure 7:
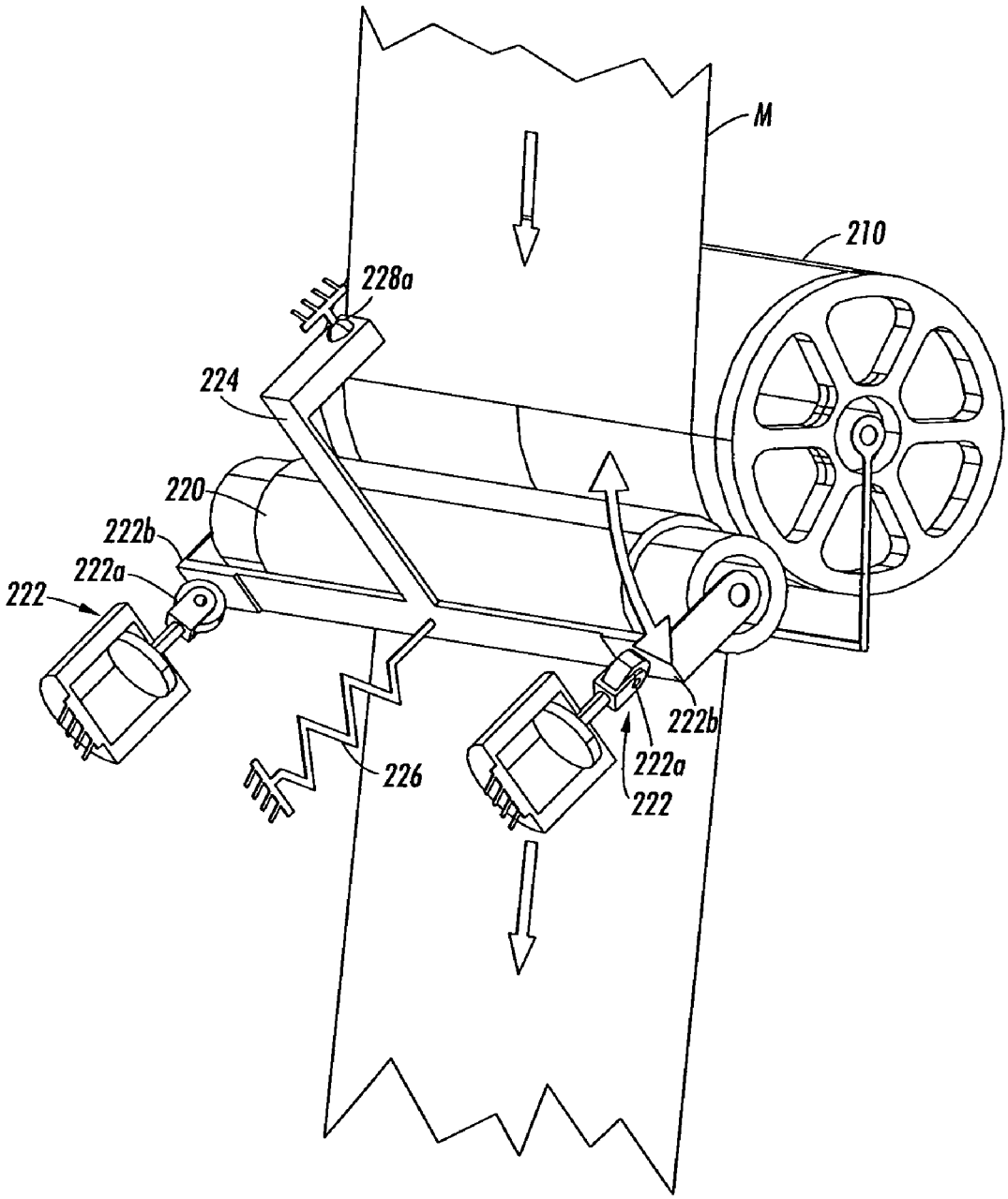
FIG. 7 is a schematic, perspective view of the fixer subsystem of FIGS. 2-4, shown in the second condition.
Figure 8:
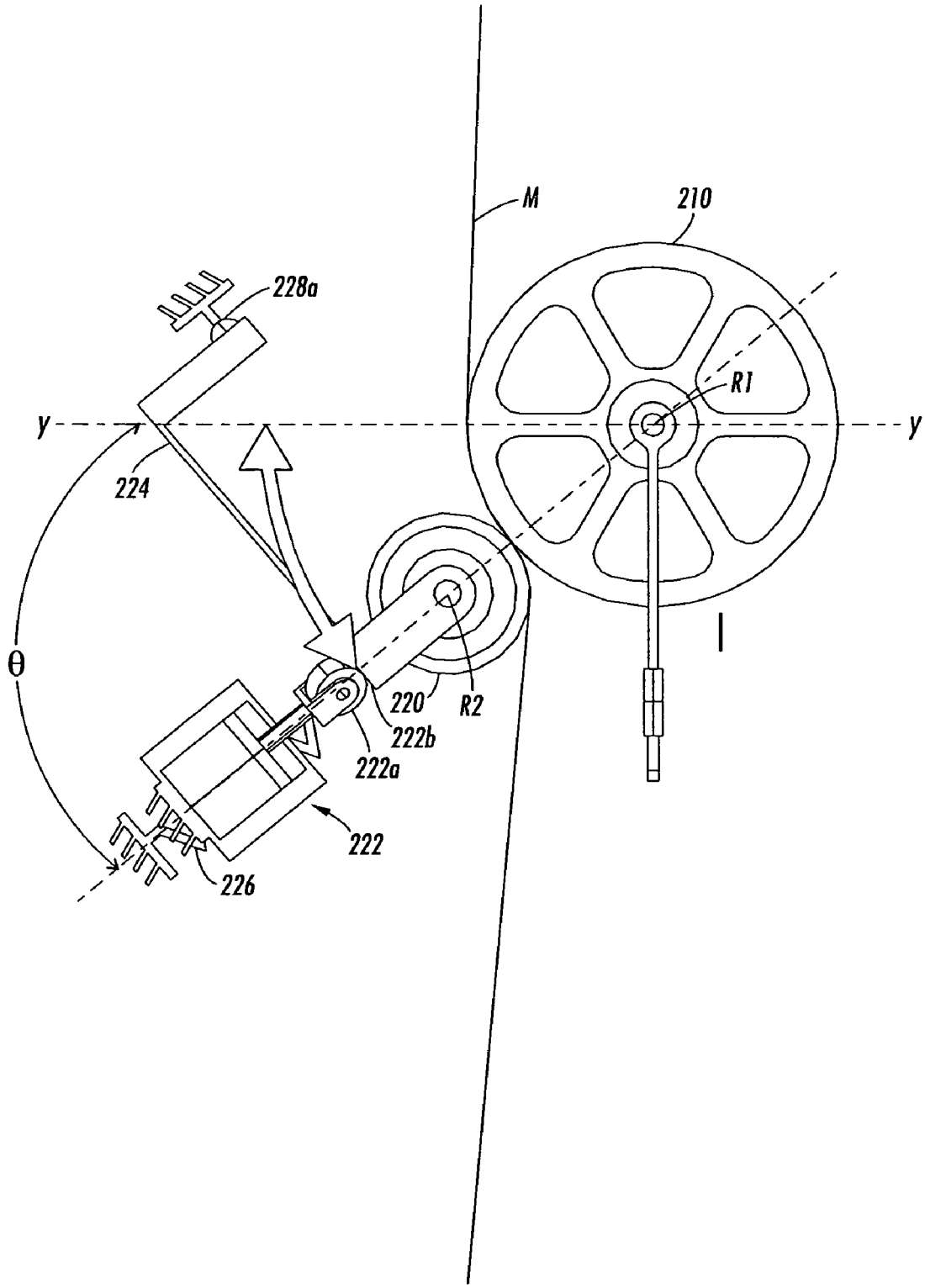
FIG. 8 is a schematic, side-elevational view of the fixer subsystem of FIGS. 2-4, shown in the second condition.

In accordance with the present disclosure, as seen in FIG. 6, where substrate media "M" first engages or contacts heated fuser drum 220, there is approximately 2° degrees of contact of substrate media "M" about fuser drum 220, above about the 9:00 o'clock position. This is done to assist in motion stability of substrate media "M". As used herein, the 0° position of pressure roll 220, relative to fuser drum 210, is located approximately at the 9:00 o'clock position, as seen in FIGS. 5 and 6, and the 35° position of pressure roll 220, relative to fuser drum 210, is located approximately at a 7:00 o'clock position, as seen in FIGS. 7 and 8.

The variable rotatable position of pressure roll 220 relative to fuser drum 210 may function to assist in image print quality by, for example, having relatively less wrap of substrate media "M" for text-type images and preventing image splitting (i.e., wherein one half the image goes to substrate media "M" and the other half of the image sticks to a fuser drum 210) which will require cleaning by a drum maintenance unit. Additionally, since heating a text image requires relatively less energy than heating a solid image, with the use of image control logic and pixel counting the image density may be calculated and active adjustments to rotatable position of pressure roll 220 relative to fuser drum 210 may be performed in order to maximize productivity of the process.

Process directional rotation of fuser drum 210 is counterclockwise (CCW) as viewed in FIG. 3. As such, substrate media "M" is moving through fixer subassembly 200 from the top and exiting from the bottom.

The foregoing description is merely a disclosure of particular embodiments and is no way intended to limit the scope of the invention. Other possible modifications are apparent to those skilled in the art and all modifications are to be defined by the following claims.

What is claimed is:

1. A fixer subsystem for use in a system for printing on a substrate media, the subsystem comprising:

a rotatable, heatable fuser drum defining an axis of rotation;

a rotatable pressure roll operatively associated with the fuser drum and defining an axis of rotation substantially parallel to the axis of rotation of the fuser drum, the pressure roll being rotatable about the axis of rotation of the fuser drum to vary a length of contact of substrate media in order to control a temperature of the substrate media, wherein the fuser drum and the pressure roll define a nip therebetween for passage of the substrate media therethrough, the fixer subsystem defining first, second and third orthogonal axes, wherein the first orthogonal axis is substantially parallel to the axis of rotation defined by the fuser drum, wherein the fixer subsystem is configured to enable the pressure roll to gimbal about at least one of the second and third orthogonal axes while remaining grounded with respect to the fuser drum in the direction of the first orthogonal axis, wherein immediately before the substrate media is provided to the fixer subsystem, the substrate media is exposed to a mid-heating station having a plurality of heating boxes, two or more of the plurality of heating boxes positioned in an opposing configuration to selectively adjust the temperature in a uniform manner on both sides of the substrate media;

wherein immediately before the mid-heating station, the substrate media is exposed to an imaging station;

wherein immediately before the imaging station, the substrate media is exposed to a pre-heating station, such that the imaging station is positioned between the pre-heating station and the mid-heating station so that heat is applied to the substrate media in at least two separate time periods in order to prevent usage of cooling units immediately after the fixer subsystem;

wherein the fixer subsystem is configured to be located downstream of the mid-heating station by a distance sufficient for the substrate media to cool down a predetermined amount; and wherein the fuser drum assists the mid-heating station by selectively applying the heat to the substrate media in predefined intervals in order to enable the mid-heating section to operate at lower temperatures;

a fuser mount including a pair of spaced apart rails, wherein the fuser drum is operatively disposed between the pair of spaced apart rails;

a load frame operatively supported on the fuser mount, wherein the fuser drum defines an axis of rotation extending through the pair of spaced apart rails, wherein the load frame is supported on the pair of spaced apart rails; and a tilting mechanism operatively interconnecting the fuser mount and the load frame, wherein the tilting mechanism is operable to vary an angular position of the pressure roll relative to the fuser drum.

2. The fixer subsystem according to claim 1, wherein a dwell time of the substrate media in contact with the fuser drum is varied by varying an angular position of the pressure roll relative to the fuser drum.

3. The fixer subsystem according to claim 1, wherein the pressure roll is rotatable about the axis of rotation of the fuser drum by an angle of less than about 35°.

4. The fixer subsystem according to claim 1, wherein the pressure roll is rotated about the axis of rotation of the fuser drum by an angle of from about 35° to 180°.

5. The fixer subsystem according to claim 1, wherein when the pressure roll is at approximately a 0° angle of rotation relative to the fuser drum, the substrate material and image is in contact with the fuser drum for approximately 2°.

6. The fixer subsystem according to claim 1, wherein the fuser drum has a temperature of about 45° C. to about 70° C.

7. The fixer subsystem according to claim 1, wherein the axis of rotation of the pressure roll is adjustable relative to the axis of rotation of the fuser drum.

8. The fixer subsystem according to claim 1, further comprising:

the fuser mount rotatably supporting the fuser drum;

the load frame rotatably supporting the pressure roll, the load frame being pivotable about the axis of rotation of the fuser drum.

9. The fixer subsystem according to claim 1, wherein the tilting mechanism includes a drive motor secured to one of the fuser mount and the load frame, a pivoting nut secured to the other of the fuser mount and the load frame, and a lead screw extending from the drive motor and through the pivoting nut, wherein the drive motor rotates the lead screw to move the pivoting nut along a length of the lead screw and vary and angle between the fuser mount and the load frame.

* * * * *